US009004716B2

(12) United States Patent
Ai

(10) Patent No.: US 9,004,716 B2
(45) Date of Patent: Apr. 14, 2015

(54) LED TUBE SOCKET, ADAPTOR AND ASSEMBLY THEREOF

(71) Applicant: High Perfection Technology Co., Ltd., New Taipei (TW)

(72) Inventor: Chih-Kuo Ai, New Taipei (TW)

(73) Assignee: High Perfection Technology Co., Ltd., New Taipei (TW)

( * ) Notice: Subject to any disclaimer, the term of this patent is extended or adjusted under 35 U.S.C. 154(b) by 234 days.

(21) Appl. No.: 13/708,406

(22) Filed: Dec. 7, 2012

(65) Prior Publication Data

US 2014/0071668 A1 Mar. 13, 2014

(30) Foreign Application Priority Data

Sep. 7, 2012 (TW) ..... 10121739 U

(51) Int. Cl.

| | |
|---|---|
| ***F21S 4/00*** | (2006.01) |
| ***F21S 8/00*** | (2006.01) |
| ***F21V 19/00*** | (2006.01) |
| ***F21K 99/00*** | (2010.01) |
| ***F21S 2/00*** | (2006.01) |
| ***F21V 21/005*** | (2006.01) |
| ***F21V 23/06*** | (2006.01) |
| *H01R 31/06* | (2006.01) |
| *F21Y 101/02* | (2006.01) |
| *F21Y 103/00* | (2006.01) |

(52) U.S. Cl.

CPC ..... *F21S 8/00* (2013.01); *F21V 19/009* (2013.01); *H01R 31/06* (2013.01); *F21K 9/17* (2013.01); *F21S 2/00* (2013.01); *F21S 4/008* (2013.01); *F21V 21/005* (2013.01); *F21V 23/06* (2013.01); *F21Y 2101/02* (2013.01); *F21Y 2103/003* (2013.01)

(58) Field of Classification Search

CPC ..... F21Y 2103/003; F21S 4/008; F21V 23/06
USPC ..... 362/219, 217.17
See application file for complete search history.

(56) References Cited

U.S. PATENT DOCUMENTS

| | | | | |
|---|---|---|---|---|
| 5,357,412 | A * | 10/1994 | Entrop et al. | 362/219 |
| 5,964,518 | A * | 10/1999 | Shen | 362/225 |
| 2012/0099318 | A1 * | 4/2012 | Liu | 362/249.02 |

FOREIGN PATENT DOCUMENTS

| | | |
|---|---|---|
| TW | M323559 | 12/2007 |

* cited by examiner

*Primary Examiner* — Sean Gramling
(74) *Attorney, Agent, or Firm* — Li & Cai Intellectual Property (USA) Office

(57) ABSTRACT

A Light Emitting Diode (LED) tube socket, an adaptor and an assembly thereof, which includes tow sockets capping either end of a LED tube. Each of the sockets has a socket main body, a pair of conductive terminals and a first threaded portion. The pair of the conductive terminals is disposed in the socket main body and electrically connecting a first LED assembly within the socket main body. The socket connects the adaptor via the threaded portions and the seal is water-tight. Two or more LED tubes are connected thereby to satisfy a required length.

8 Claims, 8 Drawing Sheets

LED TUBE SOCKET, ADAPTOR AND ASSEMBLY THEREOF

BACKGROUND

1. Field of the Invention

The instant disclosure relates to a Light Emitting Diode (LED) tube; in particular, to a LED tube socket, an adaptor, and an assembly thereof.

2. Description of Related Art

Light Emitting Diodes (LEDs) have gradually replaced the florescent or incandescent lamps because of smaller size, longer life expectancy and low energy consumption. LEDs can be adapted for a great variety of illumination systems.

The conventional LED tube comprises a cylindrical housing, a circuit board, a plurality of LEDs and two adaptors. The cylindrical housing is transparent and the circuit board along with the LEDs is disposed within the cylindrical housing. The adaptors cap the respective ends of the cylindrical housing and are electrically connectable to the circuit board for a complete LED tube.

The length of the LED tube is fixed so a joint system is employed to elongate the LED tube. As shown in TW Pat No. M323559, a fixing and cascading structure for light bar lamps is disclosed which utilizes electric connector to joint each section.

However, the conventional LED tube adaptors cannot be rapidly mounted or dismounted. The connection is relatively unstable and prone to detach from one another. In addition, the seal is not watertight.

Furthermore, after the LED tubes are connected by a plurality of adaptors, the light impermeable adaptor bodies cannot allow light rays through. As a result, the light source becomes discrete due to the adaptor interruption.

To address the above issues, the inventor strives via associated experience and research to present the instant disclosure, which can effectively improve the limitation described above.

SUMMARY OF THE INVENTION

The object of the instant disclosure is to provide a LED tube socket, an adaptor, and an assembly thereof for connecting more than one LED tube together rapidly and reliably to satisfy a required length. In addition, the instant disclosure provides a watertight connection to protect the LEDs from fluid damage. Moreover, the light source is continuous because the sockets and adaptors are made from transparent materials.

According to one exemplary embodiment of the instant disclosure, the LED tube socket, adaptor and assembly thereof comprise two sockets capping either end of a LED tube. The LED tube includes a cylindrical housing and at least one first LED assembly therein. Each of the sockets has a socket main body, which has a first threaded portion for fastening, and two conductive terminals, which are electrically connectable to the first LED assembly. The LED tube socket, adaptor and assembly thereof further comprise an adaptor which includes an adaptor main body, two rotation fittings and two conducting members. Each of the two rotation fittings has second threaded portion corresponding to the first threaded portion. The rotation fittings connect either end of the adaptor main body. The two conducting members are arranged within the adaptor main body and conforming to the conductive terminal alignment. That is to say, one pair of the conductive terminals is received by conducting members over one side of the adaptor. The first and second threaded portions of the adaptor and rotation fittings conformingly fit each another so to enable serial connection of adjacent LED tubes.

The instant disclosure also provides a LED tube socket comprising two sockets capping either end of the tube. The LED tube includes a cylindrical housing and at least one first LED assembly therein. Each of the sockets has a socket main body and a pair of conductive terminals. The socket main body is formed with a first threaded portion protruding outwardly. The pair of conductive terminals is arranged on the socket main body and electrically connectable to the first LED assembly.

The instant disclosure further provides an adaptor which comprises an adaptor main body, two rotation fittings formed with second threaded portion and two conducting members arranged within the adaptor main body. The rotation fittings connect either end of the adaptor main body.

The instant disclosure provides a faster and more reliable connection between two neighboring LED tubes by threads mating. The seal is watertight to prevent from liquid invasion. Furthermore, the sockets and adaptors are made from transparent materials and LED tubes can be disposed within the adaptor main body thus the light source is continuous without interruption.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 6:
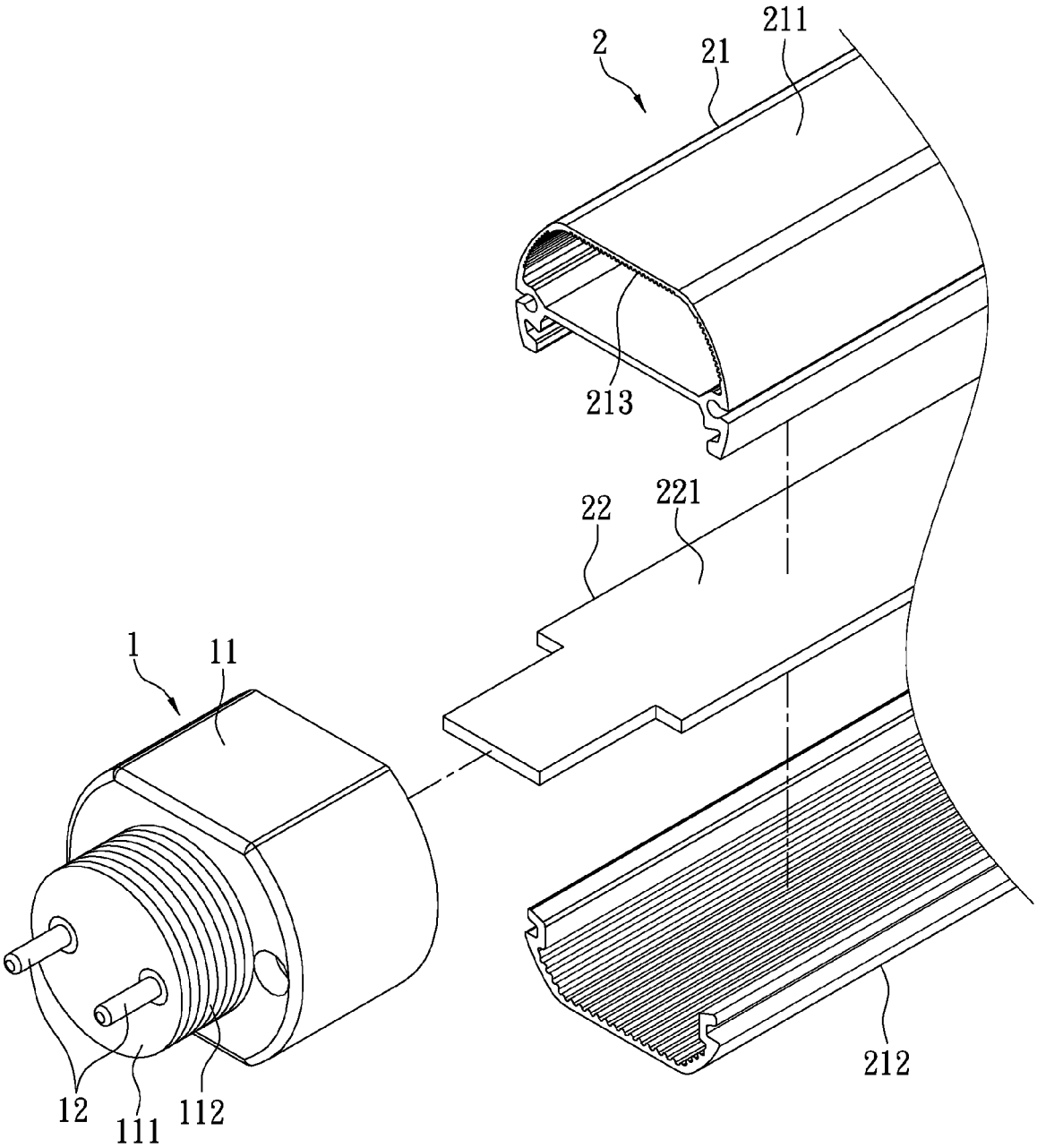
FIG. 6 illustrates an exploded view of a LED tube and a socket according to the instant disclosure.
Figure 7:
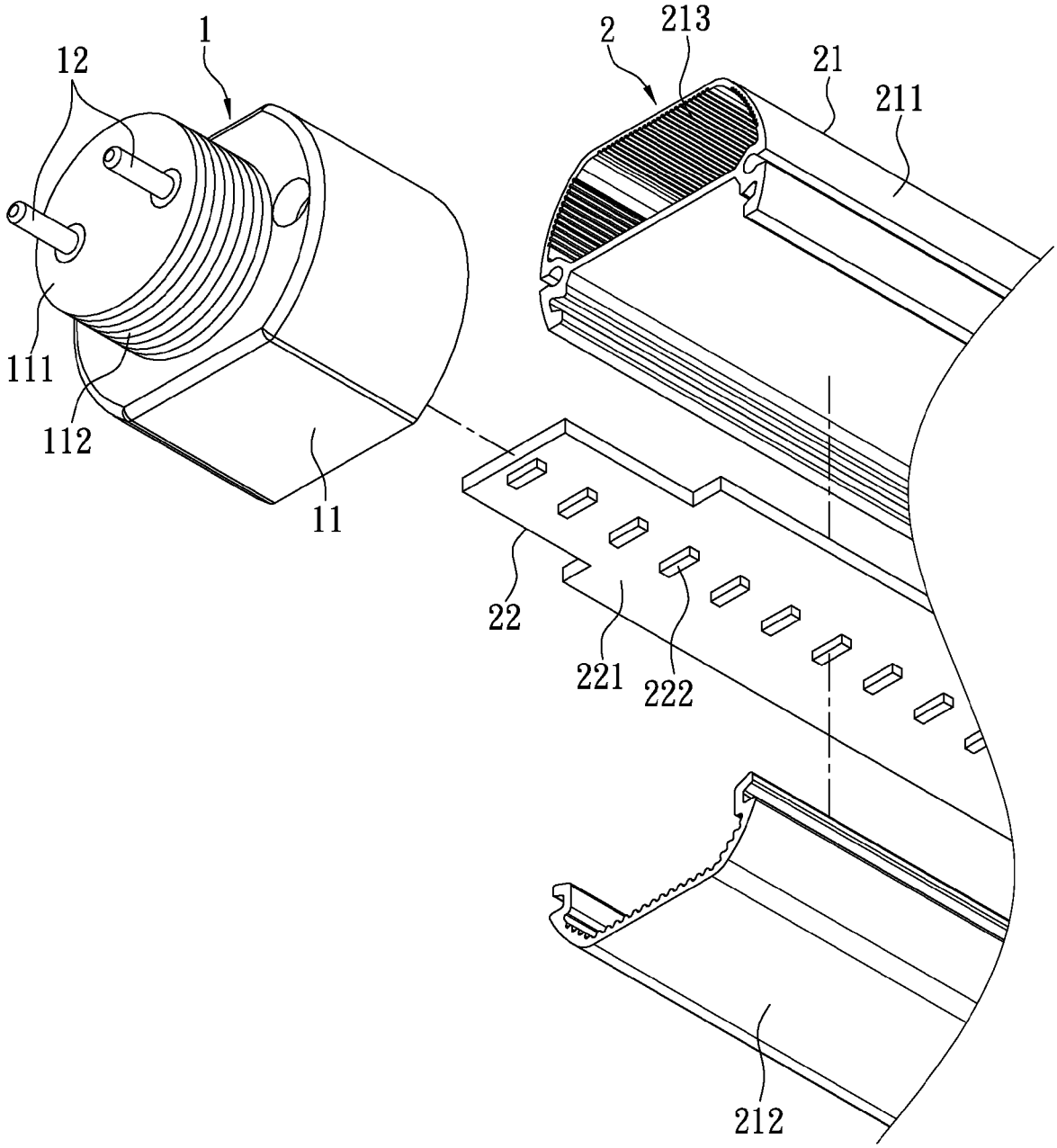
FIG. 7 illustrates an exploded view from another angle of a LED tube and a socket according to the instant disclosure.

With reference to FIGS. 1~4. The instant disclosure provides a Light Emitting Diode (LED) tube socket comprising two sockets 1 capping either end of a LED tube 2. The LED tube 2 includes a housing 21 and at least one first LED assembly 22 (as shown in FIGS. 6 and 7). The housing 21 includes a holder 211 preferably made from materials having good heat conductive efficiency such as aluminum and a cover 212. The holder 211 is a hollow cylinder and the structure and dimension thereof are not limited thereto. Optionally, the holder 211 may be formed with a heat dissipation portion 213, which has a plurality of grooves and peaks to increase the surface area.

The cover 212 is made form polycarbonate (PC) or the like to appear transparent to the light emitted by the LED tube 2. In other words, light output generated/emitted from the LED tube 2 is permeable through the cover 212. The cover 212 preferably has an arced hollow cross-section, although the specific arrangement thereof can differ according to particular design preference or other practice need. The holder 211 and cover 212 are detachably engaged by detents or screws to form the hollow housing 21 for retaining the first LED assembly. The cover 212 envelopes the first LED assembly 22 and the light rays are permeable there-through. Additionally, the holder 211 can be fixed by tapes or clamps to a desired location, such as a wall/ceiling. However, it is worth noted that the cover 212 is not restricted to this particular structure.

Figure 5A:
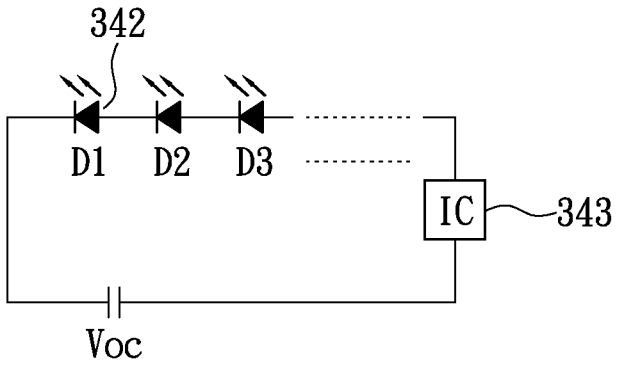
FIG. 5A illustrates a circuiting of an adaptor according to the instant disclosure.
Figure 5B:
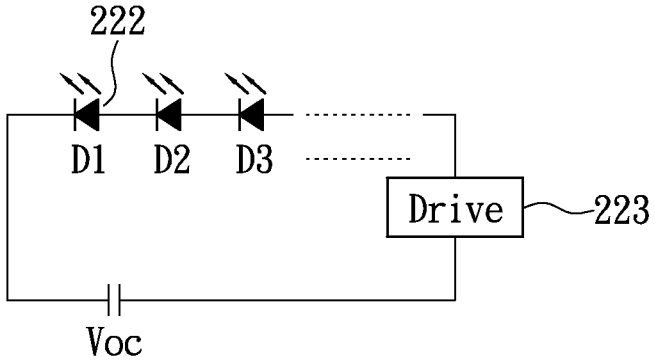
FIG. 5B illustrates a circuiting of a LED tube according to the instant disclosure.

The first LED assembly 22 is disposed in the housing 21. The first LED assembly 22 includes a circuit board 221 and a plurality of LEDs 222 arranged on the circuit board 221. In one embodiment, the circuit board 221 is an aluminum plate having an elongated shape formed with electrical traces patterned thereon. However, the structure of the circuit board 221 is not restricted thereto. The LEDs 222 are disposed on the circuit board 221 facing the cover 212 by a predetermined distance and electrically connected to the circuit board 221. The circuit board 221 may further incorporate a LED driver 223 for regulating power (as shown in FIG. 5B). The two sockets 1 electrically connect the first LED assembly 22 and are attached on either end of the housing 21. In use, electric power is conducted through the socket 1 to the first LED assembly 22, powering the LEDs to emit light that passes through the cover 212 to the exterior. As an alternative, LED drivers and/or other control circuit components may be arranged externally outside the LED tube 2.

Each of the sockets 1 has a socket main body 11 and two conductive terminals 12. The socket main body 11 is made from electrically insulation materials with high light permeability. That is to day, the light source can pass through the sockets 1 instead of being concealed there-from. Moreover, the first LED assembly 22 can stretch into the interior of the socket main body 11, and therefore the light ray comes out from the entire LED tube 2 as well as the sockets 1. The socket main body 11 is hollow with one opening and engaged with the housing 21 by detent. The socket main body 11 includes a plurality of first threaded portion 112 protruding from the closed end of the socket main body 11 resembling a coiled pillar. The pair of conductive terminals 12 is made from electrically conductive metals and electrically connecting the first LED assembly 22 by wires at one end, whereas the other end thereof extends from the socket main body 11 to conduct power and connect another LED tube 2. The power (for example, direct current power) travels through the conductive terminals 12 and is regulated by either internal LED driver or an external controller.

Figure 3:
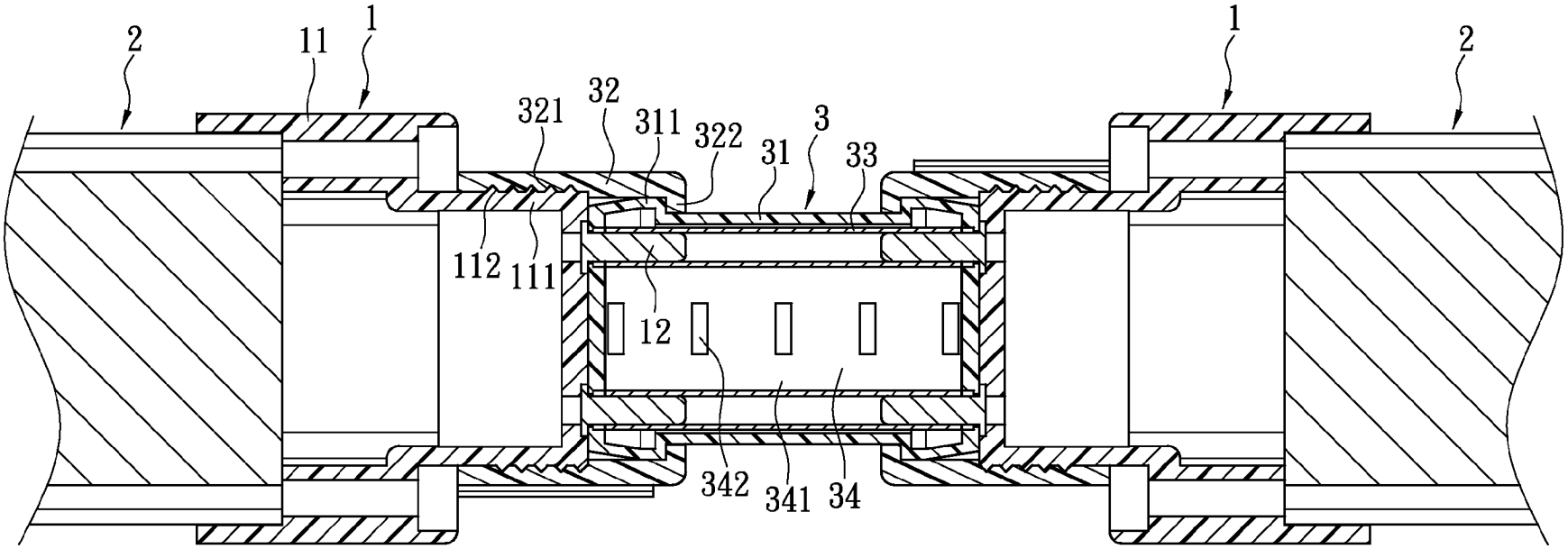
FIG. 3 illustrates a front cross sectional view of a LED tube socket, an adaptor and an assembly thereof according to the instant disclosure.
Figure 4:
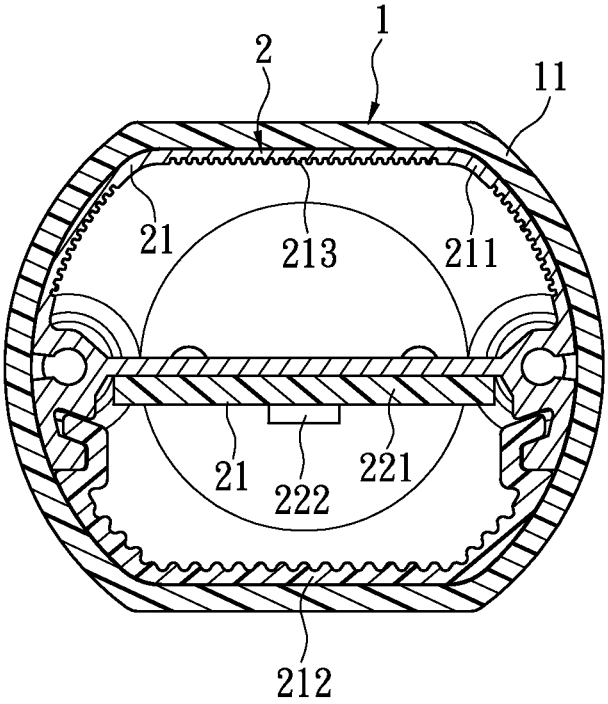
FIG. 4 illustrates a side cross sectional view of a LED tube and an adaptor according to the instant disclosure.
Figure 8:
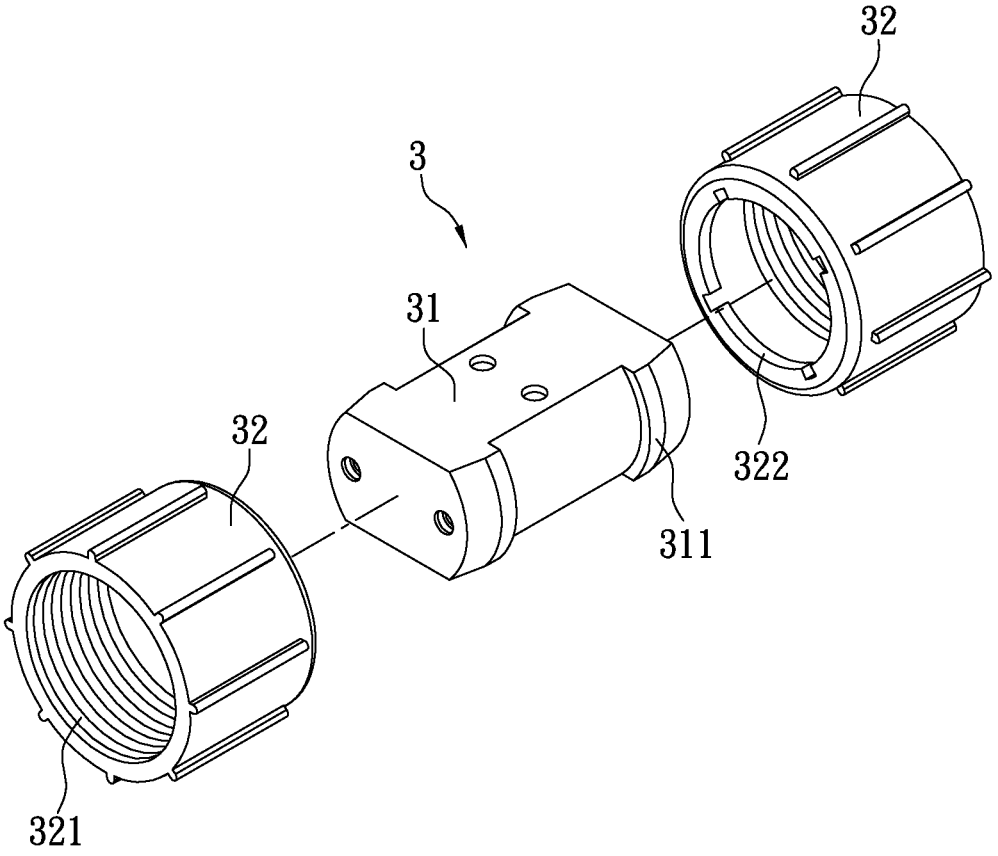
FIG. 8 illustrates an exploded view of a LED tube and a socket according to the instant disclosure.

With the reference to FIG. 8. The instant disclosure also provides an adaptor 3. The adaptor 3 joints two neighboring LED tubes 2 by connecting two sockets 1 from two different LED tubes 2. Hence, the adaptor 3 allows the LED tube 2 being extendable to a required length. The adaptor 3 includes an adaptor main body 31, two rotation fittings 32 and two conducting members 33 (as shown in FIG. 3). The adaptor main body 31 is made from electrical insulation materials with high light permeability so the light rays can travel through the adaptor main body 31 freely. The adaptor main body 31 is a hollow body and locking portion 311 projecting around the edge thereof to position the two rotation fittings 32.

The two rotation fittings (e.g. lock nut) 32 are made from electrical insulating materials with high light permeability. The rotation fittings 32 are substantially hollow cylindrical with second threaded portion 321 formed on the inner tubular surface thereof. In the instant embodiment, the rotation fittings 32 mates with the first threaded portion 112 of the socket 1. However, the second threaded portion 321 can also form on the outer wall of the rotation fittings 32 (not shown) and still fittingly mate with the first threaded portion 112. The two rotation fittings 32 envelope either end of the adaptor main body 31 in an axially mobile manner. The interior edge of the rotation fittings 32 is formed with ridges 322 abutting against the locking portions 311, which assist in gripping the rotation fitting 32. When the rotation fitting 32 moves toward the edge of the adaptor main body 31, the locking portion 311 stops the rotation fitting 32 from dismounting by locking the ridge 322.

The two conducting members 33 are made from conductive metals and arranged inside the hollow adaptor main body 31. The conducting members 33 are electrically connectable to a second LED assembly 34. The conducting members 33 serve as the electrical conductive passage between the conductive terminals 12 and the adjacent LED assembly. In the instant embodiment, the conducting members 33 are tubes conforming to the pair of conductive terminals 12. Hence the pair of conductive terminals 12 is inserted to the conducting members for serial electrical conduction. Alternatively, each of the conducting member 33 can be divided into two sections (not shown) and arranged respectively on either end of the adaptor main body 31.

The second LED assembly 34 is disposed within the adaptor main body 31 and including a circuit board 341 and a plurality of LEDs 342 arranged thereon. The LEDs 342 are disposed in a predetermined interval and electrically connectable to the circuit board 341. The circuit board 341 may have an IC 343 arranged thereon (as shown in FIG. 5A). In the instant embodiment, the second LED assembly 34 emits light rays passing through the light permeable adaptor main body 31 and rotation fittings 32. If the adaptor main body 31 is not equipped with the second LED assembly 34, the adaptor main body 31 and rotation fittings 32 can be made from light impermeable materials.

Figure 1:
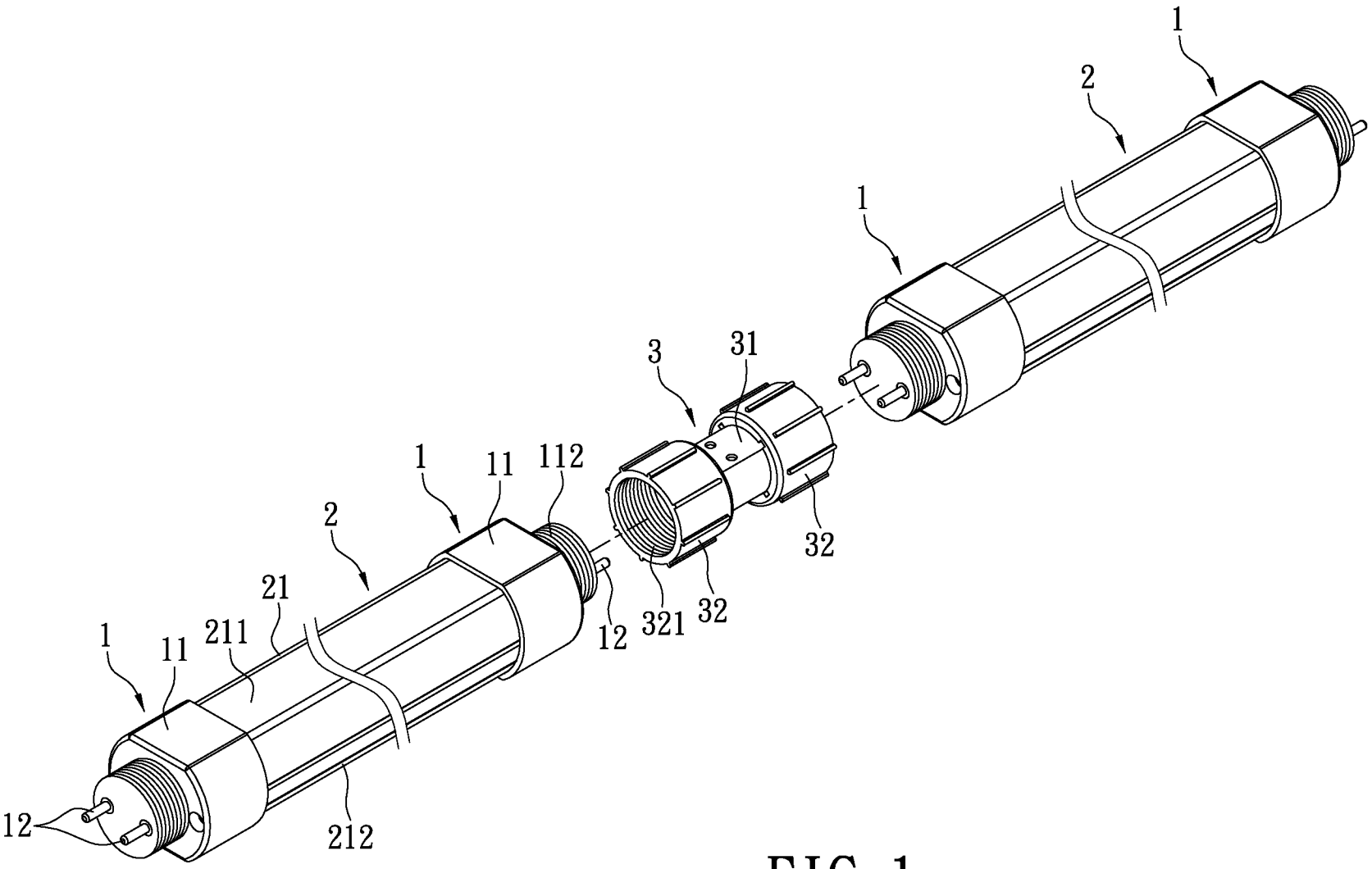
FIG. 1 illustrates an exploded view of a LED tube socket, an adaptor and an assembly thereof according to the instant disclosure.
Figure 2:
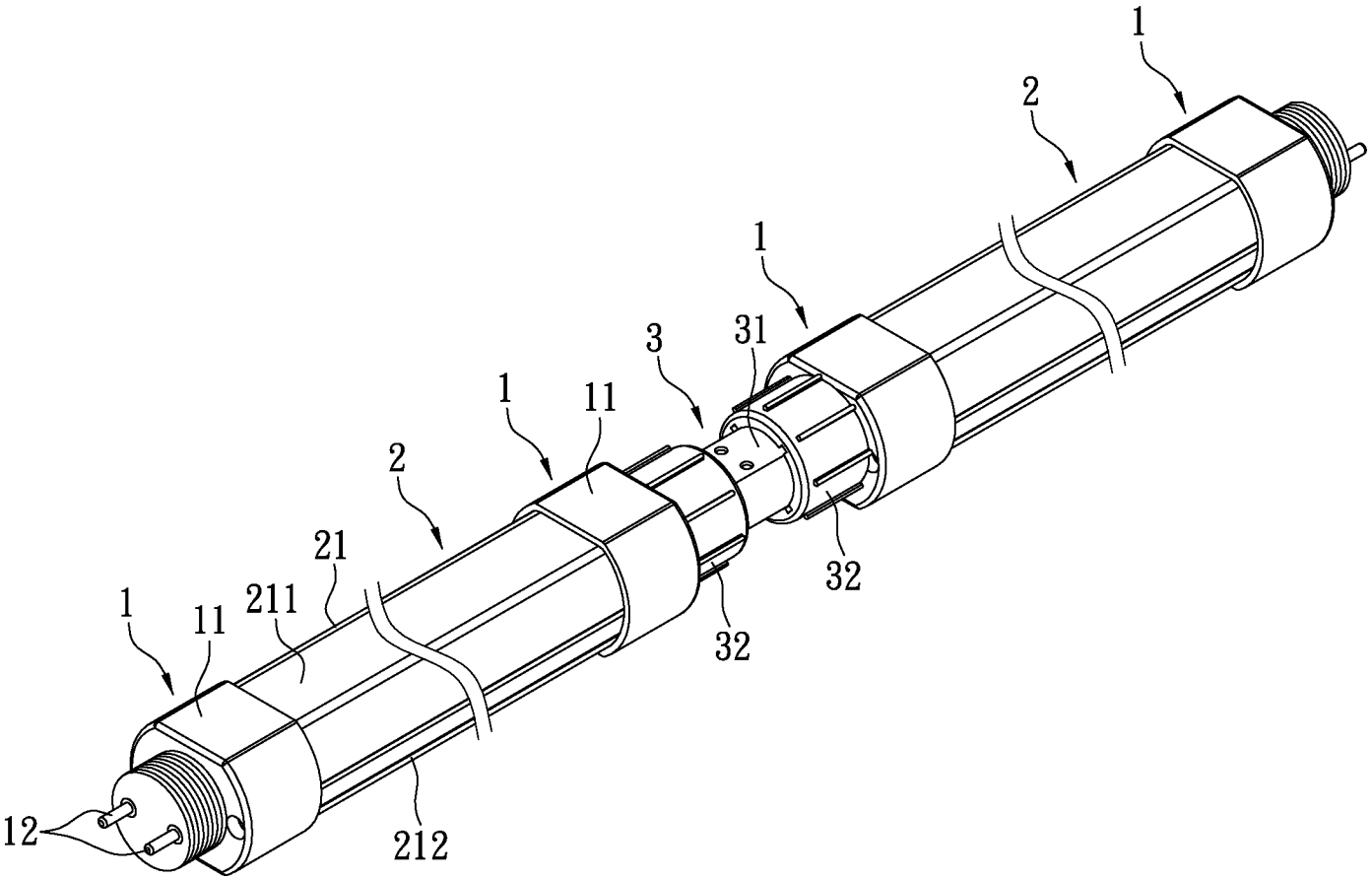
FIG. 2 illustrates a perspective view of a LED tube socket, an adaptor and an assembly thereof according to the instant disclosure.

With reference to FIGS. 1~3. The socket 1 and adaptor 3 are electrically connected by the conductive terminals 12 via the conducting members 33. More specifically, the conductive terminals 12 electrically contact the conducting members 33 to allow electric current passing between the socket 1 and adaptor 3. The rotation fittings 32 engage with the socket 1 by mating the first and second threaded portions 112, 321 to secure the mounting of the socket 1 and adaptor 3. Similarly, the free end of the LED tube 2 connects to another adjacent LED tube 2 in an identical way. In addition, the LED tubes 2 can be in parallel circuit connection. Furthermore, a gasket or O-ring (not shown) is disposed between the adaptor 3 and the socket 1 to support watertight enclosure.

In summary, the LED tube 2 can be fast mounted onto the adaptor 3 by the first and second threaded portions 112, 321 to satisfy a required length in serial connection. In addition, the seal between the first and second threaded portions 112, 321 are watertight to prevent from liquid damage. Furthermore, the second LED assembly 34 can be disposed within the adaptor main body 31 to enable the light rays passing through the transparent adaptor 3 and providing a continuous light distribution.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A light emitting diode (LED) tube socket, adaptor and assembly thereof comprising:

a LED tube including an elongated housing and at least one first LED assembly;

two sockets respectively arranged on each end of the LED tube, each of the sockets including:

a socket main body having a first threaded portion;

a pair of conductive terminals arranged on the socket and electrically connecting the first LED assembly; and an adaptor including an adaptor main body, two rotation fittings and two conducting members, each of the rotation fittings disposed on the adaptor main body and having a second threaded portion, the conducting members electrically connecting the first LED assembly;

wherein the pair of the conductive terminals are conformingly inserted into the conducting members and two adjacent LED tubes are engaged by mating the first and second threaded portions;

wherein the socket main body is light permeable and the first LED assembly extends to the interior thereof.

2. The LED tube socket, adaptor and assembly thereof according to claim 1, wherein the rotation fittings axially and rotatably move along the adaptor main body and engage thereto.

3. The LED tube socket, adaptor and assembly thereof according to claim 1, wherein the first threaded portion protrudes outwardly from the socket main body and mates with the second threaded portion of the adapter main body.

4. The LED tube socket, adaptor and assembly thereof according to claim 1, wherein the adaptor main body is formed with a locking portion around the edge thereof and each of the two rotation fittings is formed with a ridge corresponding to the locking portion.

5. A light emitting diode (LED) tube socket, adaptor and assembly thereof comprising:

a LED tube including an elongated housing and at least one first LED assembly;

two sockets respectively arranged on each end of the LED tube, each of the sockets including:

a socket main body having a first threaded portion;

a pair of conductive terminals arranged on the socket and electrically connecting the first LED assembly; and an adaptor including an adaptor main body, two rotation fittings and two conducting members, each of the rotation fittings disposed on the adaptor main body and having a second threaded portion, the conducting members electrically connecting the first LED assembly;

wherein the pair of the conductive terminals are conformingly inserted into the conducting members and two adjacent LED tubes are engaged by mating the first and second threaded portions;

wherein the adaptor main body and the two rotation fittings are light permeable, and a second LED assembly is disposed within the adaptor main body and electrically connecting the two conducting members.

6. The LED tube socket, adaptor and assembly thereof according to claim 5, wherein the rotation fittings axially and rotatably move along the adaptor main body and engage thereto.

7. The LED tube socket, adaptor and assembly thereof according to claim 5, wherein the first threaded portion protrudes outwardly from the socket main body and mates with the second threaded portion of the adapter main body.

8. The LED tube socket, adaptor and assembly thereof according to claim 5, wherein the adaptor main body is formed with a locking portion around the edge thereof and each of the two rotation fittings is formed with a ridge corresponding to the locking portion.

* * * * *